US009959967B2

(12) United States Patent
Lee

(10) Patent No.: US 9,959,967 B2
(45) Date of Patent: May 1, 2018

(54) MAGNETIC DEVICES AND METHODS FOR MANUFACTURE USING FLEX CIRCUITS

(71) Applicant: Analog Devices, Inc., Norwood, MA (US)

(72) Inventor: Check F. Lee, Bedford, MA (US)

(73) Assignee: Analog Devices, Inc., Norwood, MA (US)

( * ) Notice: Subject to any disclaimer, the term of this patent is extended or adjusted under 35 U.S.C. 154(b) by 177 days.

(21) Appl. No.: 14/702,522

(22) Filed: May 1, 2015

(65) Prior Publication Data

US 2015/0332836 A1 Nov. 19, 2015

Related U.S. Application Data

(60) Provisional application No. 61/993,942, filed on May 15, 2014.

(51) Int. Cl.

| | |
|---|---|
| ***H01F 27/28*** | (2006.01) |
| ***H01F 5/00*** | (2006.01) |
| ***H01F 27/24*** | (2006.01) |
| ***H01F 41/06*** | (2016.01) |
| ***H01F 19/00*** | (2006.01) |

(52) U.S. Cl.

CPC ..... *H01F 27/24* (2013.01); *H01F 19/00* (2013.01); *H01F 27/2804* (2013.01); *H01F 27/2823* (2013.01); *H01F 27/2895* (2013.01); *H01F 41/06* (2013.01); *H01F 2027/2814* (2013.01); *Y10T 29/49073* (2015.01)

(58) Field of Classification Search

CPC ..... H01F 5/00; H01F 27/28; H01F 30/16
USPC ..... 336/200, 229, 232
See application file for complete search history.

(56) References Cited

U.S. PATENT DOCUMENTS 3,132,316 A * 5/1964 Elmen ..... H03F 9/02 200/11 H
4,975,671 A * 12/1990 Dirks ..... H01F 17/0033 336/200

(Continued)

FOREIGN PATENT DOCUMENTS

CN 1324081 A 11/2001
CN 101018446 A 8/2007

(Continued)

OTHER PUBLICATIONS

U.S. Appl. No. 14/205,873, filed Mar. 12, 2014, Lee et al.

(Continued)

*Primary Examiner* — Tsz Chan
(74) *Attorney, Agent, or Firm* — Wolf, Greenfield & Sacks, P.C.

(57) ABSTRACT

Magnetic devices, and associated methods of manufacture, using flex circuits. Conductive flex circuit traces, or combinations of such traces with conductive printed circuit board or other substrate traces, form windings around toroidal ferromagnetic cores. Bending the flex circuit into a partial loop or a full loop forms partial or full windings respectively. Bonding or flow soldering electrically connects the windings together and to a printed circuit board or other substrate. The methods yield transformers with high conversion efficiency, are compatible with conventional printed circuit boards and readily available high-volume assembly equipment, and avoid the higher cost of manually made windings.

20 Claims, 7 Drawing Sheets

(56) References Cited

U.S. PATENT DOCUMENTS

| | | | | |
|---|---|---|---|---|
| 5,257,000 | A | 10/1993 | Billings et al. | |
| 5,392,020 | A | 2/1995 | Chang | |
| 5,469,124 | A | 11/1995 | O'Donnell et al. | |
| 5,760,669 | A | 6/1998 | Dangler et al. | |
| 6,040,753 | A | 3/2000 | Ramakrishnan et al. | |
| 6,069,548 | A | 5/2000 | Baarman et al. | |
| 6,073,339 | A | 6/2000 | Levin | |
| 6,114,939 | A | 9/2000 | Wittenbreder | |
| 6,144,281 | A * | 11/2000 | Lorris | H02K 3/26 310/208 |
| 6,188,305 | B1 | 2/2001 | Chang et al. | |
| 6,674,355 | B2 | 1/2004 | Harding | |
| 6,796,017 | B2 | 9/2004 | Harding | |
| 6,820,321 | B2 | 11/2004 | Harding | |
| 6,927,663 | B2 | 8/2005 | Iverson et al. | |
| 7,009,486 | B1 * | 3/2006 | Goeke | H01F 30/16 336/229 |
| 7,120,492 | B2 | 10/2006 | Iverson et al. | |
| 7,436,282 | B2 | 10/2008 | Whittaker et al. | |
| 7,477,124 | B2 | 1/2009 | Harding | |
| 2004/0032313 | A1 | 2/2004 | Ferencz et al. | |
| 2005/0231316 | A1 | 10/2005 | Sato | |
| 2007/0296533 | A1 | 12/2007 | Springett | |
| 2009/0126983 | A1 | 5/2009 | Harvey et al. | |
| 2009/0128273 | A1 * | 5/2009 | Huss | H01F 27/2895 336/61 |
| 2011/0285492 | A1 * | 11/2011 | Wang | H01F 27/306 336/198 |
| 2012/0194314 | A1 | 8/2012 | Mo | |
| 2012/0320532 | A1 | 12/2012 | Wang | |
| 2013/0278370 | A1 * | 10/2013 | Finney | H01F 27/306 336/60 |
| 2015/0101854 | A1 | 4/2015 | Lee et al. | |

FOREIGN PATENT DOCUMENTS

| | | | |
|---|---|---|---|
| CN | 201754363 | U | 3/2011 |
| CN | 201927466 | U | 8/2011 |
| CN | 102918609 | A | 2/2013 |
| CN | 202841710 | U | 3/2013 |
| DE | 25 41 871 | A1 | 3/1977 |
| EP | 0 033 441 | A1 | 8/1981 |
| EP | 0318955 | A1 | 6/1989 |
| JP | 54110424 | A | 8/1979 |
| JP | S61-051715 | U | 4/1986 |
| JP | 02010705 | A * | 1/1990 |
| JP | 03044906 | A | 2/1991 |
| JP | H04-337610 | A | 11/1992 |
| JP | H06-061055 | A | 3/1994 |
| JP | H07-027117 | U | 5/1995 |
| JP | H07-312313 | A | 11/1995 |
| JP | 08031640 | A | 2/1996 |
| JP | 2009-212265 | A | 9/2009 |
| TW | 200839801 | A | 10/2008 |

OTHER PUBLICATIONS

Chinese Office Action dated Aug. 1, 2016 and English translation thereof in connection with Chinese Application No. 201510245393.7.

* cited by examiner

400

MAGNETIC DEVICES AND METHODS FOR MANUFACTURE USING FLEX CIRCUITS

RELATED APPLICATIONS

This application claims priority to provisional application U.S. Ser. No. 61/993,942 entitled "Magnetic Devices And Methods For Manufacture Using Flex Circuits", filed on May 15, 2014. The subject matter of the aforementioned provisional application is hereby incorporated by reference in its entirety.

FIELD OF THE DISCLOSURE

The subject matter of this application relates to inductors and transformers and methods to manufacture these electrical devices, and in particular to methods of using flexible circuit connectors or "flex circuits" for simplified low-cost assembly of transformers and inductors with magnetic cores.

BACKGROUND

Transformers transfer electrical energy by inductive coupling between conductive windings. For example, a transformer may allow alternating voltages and/or currents of magnetically coupled inductor windings to be stepped up or down. The ratio of turns in a primary winding to those in a secondary winding determines the stepping ratio in ideal transformers. The windings may encircle a toroidal core comprising ferrite or other easily magnetized ferromagnetic material. A toroidal ferromagnetic core provides a closed magnetic loop to more efficiently contain the magnetic flux and inductively link the windings.

Manufacturers create transformers in various sizes, depending on the relevant application. If the transformer is sufficiently large, e.g., greater than three inches in size, a conventional winding machine may be used to place conductors around the toroid. If the toroid is comparable to one inch in size, conventional pull-and-hook machinery may be used to aid the hand winding process. For smaller toroids, the windings are typically all wound by hand, leading to significant manufacturing costs.

One known method to avoid hand winding a toroid is to use a split ferromagnetic core, which allows machine-made windings to be inserted. The manufacturer may then mechanically attach the ferromagnetic material pieces. This assembly method may however degrade the magnetic efficiency of the resulting device, compared with one made with a continuous unbroken toroid. Other methods embed ferromagnetic materials into a printed circuit board, which may further increase manufacturing costs compared with the use of conventional printed circuit boards. Thus, while toroidal ferrite inductors or transformers are used in many applications because of their high efficiency, difficulties related to manufacturing costs and complexities remain unsolved.

Accordingly, there is a need in the art for inexpensively winding small toroidal inductors and transformers, such as those designed for attachment to conventional printed circuit boards.

SUMMARY OF THE DISCLOSURE

In certain embodiments, a magnetic device is provided that discloses a single-piece toroid and at least one flex circuit comprising at least one conductive trace that forms at least one turn around the toroid in order to inductively couple at least one electrical current to the toroid. In certain embodiments, a method of manufacturing a magnetic device is provided that discloses producing an assembly by wrapping a flex circuit comprising at least one conductive trace around a single-piece toroid to form at least one turn for inductively coupling at least one electrical current to the toroid. In certain embodiments, a transformer is provided that discloses a substrate having a plurality of trace segments formed therein, a toroidal magnetic core, and a pair of flex circuits, each flex circuit wrapping around a respective leg or angular sector of the core, and having a plurality of trace segments formed therein, wherein a first subset of trace segments from the first flex circuit, a first subset of trace segments from the second flex circuit, and a first subset of trace segments from the substrate are electrically interconnected to each other to form a first winding of the transformer, and a second subset of trace segments from the first flex circuit, a second subset of trace segments from the second flex circuit, and a second subset of trace segments from the substrate are electrically interconnected to each other to form a second winding of the transformer.

DETAILED DESCRIPTION

This description discloses toroidal inductors and transformers based on flex circuits and printed circuit boards, and methods for their manufacture. Flex circuits comprise flexible dielectric films having at least one flexible conductor layer therein, and are widely used in industry. The windings in these magnetic devices may be created by bending the flex circuit material into a partial loop or a full loop around the toroidal ferromagnetic core. Portions of the windings or turns may comprise conductive traces on a printed circuit board or other substrate such as another flex circuit. Bonding or solder flow methods for example may electrically and mechanically interconnect the flex circuit windings and/or conductive pads or traces on a printed circuit board or other substrate.

Figure 1:
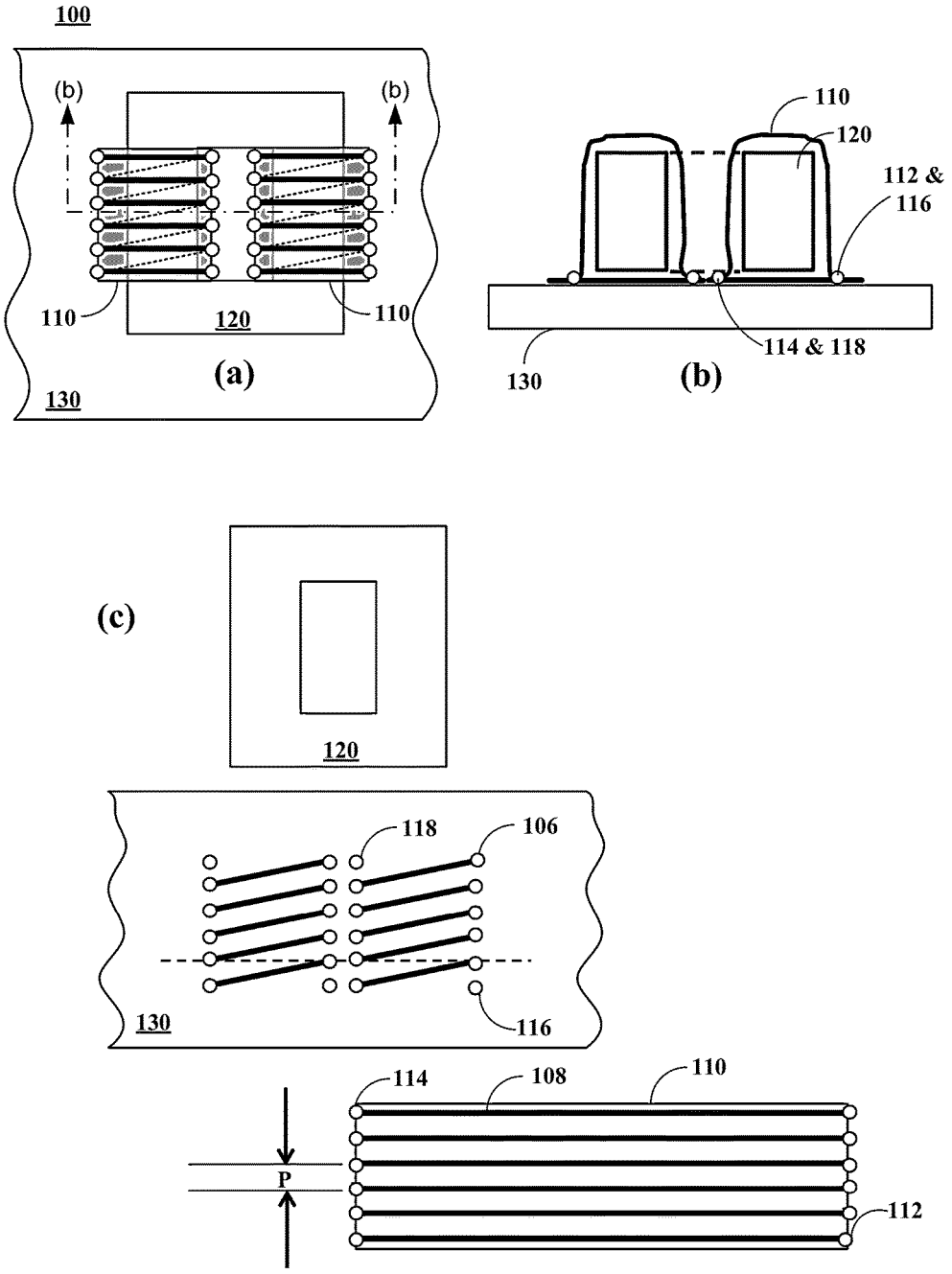
FIG. 1 is a diagram depicting an exemplary transformer according to an embodiment of the present invention.

FIG. 1 illustrates a transformer 100 according to an embodiment of the present invention. FIG. 1(*a*) illustrates a plan view of the transformer 100. FIG. 1(*b*) illustrates a cross-sectional view of the transformer 100 taken along line (b)-(b) in FIG. 1(*a*). FIG. 1(*c*) illustrates the transformer 100 components prior to assembly. The transformer 100 may include a pair of flex circuits 110, a ferromagnetic core 120, and a substrate 130. The ferromagnetic core 120 may be mounted on the substrate 130. Each flex circuit 110 may wrap around a portion of the ferromagnetic core 120. The flex circuits 110 and the substrate 130 may have conductive traces 106 and 108 formed therein that may be electrically connected to each other to form a pair of windings about the ferromagnetic core 120, which complete the transformer circuit.

In this embodiment, the substrate 130 may comprise a dielectric material with at least one conductive layer, shown here as an outer surface for simplicity. The conductive layer may actually be located under an outer dielectric layer through which access paths have been opened, by etched vias, drilling, or other manufacturing techniques. The substrate 130 may include multiple conductive layers therein which may each be electrically accessed from outside at predetermined locations, again through vias or other structures. In one embodiment, the substrate 130 may be a printed circuit board. In another embodiment, the substrate 130 may be a substrate flex circuit.

The substrate 130 may include one or more of the conductive traces 106 that are arranged to interface with the traces 108 in a corresponding flex circuit 110. In the example of FIG. 1, the traces 106 are shown as parallel line segments of equal length with each line segment separated by a predetermined distance. The end of each conductive trace 106 is shown to align with the opposite end of a neighboring trace 106 in this embodiment. When the traces 106 are connected to the traces 108 of the flex circuit 110, they complete a multi-turn winding that loops around the ferromagnetic core 120.

The flex circuit 110 may comprise a dielectric film, made of materials such as polyimide for example, with one or more flex circuit conductive traces 108. Six flex circuit conductive traces 108 are shown in this example. The flex circuit conductive traces 108 may be parallel, equally spaced, and aligned longitudinally with the flex circuit 110 as shown in this embodiment. The flex circuit conductive traces 108 may be made of ductile metal layers like copper or gold, which may be ten to twenty-five micrometers in thickness for example. The flex circuits 110 may have a minimum bending radius of approximately ten times the flex circuit conductive trace 108 thickness, to prevent cracks from forming in the flex circuit conductive traces 108.

The geometries of the flex circuits 110 may be interrelated, with the flex circuit conductive traces 108 often spaced apart by twice the flex circuit 110 conductor thickness. The flex circuit conductive traces 108 may be spaced periodically at pitch intervals P of fifty microns, for example. The geometries of the flex circuits may also be related to the substrate feature dimensions, with the flex circuit conductive traces 108 often spaced apart by twice the trace 106 widths to help ensure proper interconnection.

The flex circuit conductive traces 108 may be located on one or both sides of the flex circuit 110 dielectric film. The flex circuit conductive traces 108 are usually embedded between various dielectric layers and may be electrically accessed from outside at particular locations. Contact openings may be formed photolithographically or through laser ablation or other conventional production methods for example. In this figure, two such contact openings 112 and 114 may be connected to substrate contact pads 116 and 118, respectively. Contact openings and pads are generally shown oversized for clarity, but may be substantially the same size as flex circuit conductive trace 108 widths.

The ferromagnetic core 120 may be attached to the substrate 130 using for example glue or other means familiar to those in the art of circuit manufacturing. The flex circuit 110 may be wrapped substantially longitudinally around the ferromagnetic core 120 and attached to the substrate 130 using bonding, flow soldering, or other known manufacturing methods. The flex circuit 110 is assembled such that the flex circuit conductive traces 108 are electrically connected to corresponding conductive portions of the substrate 130, such as the conductive traces 106, the contact pads like 116 and 118, or related vias.

The result of the assembly of the flex circuit 110 and the substrate conductive traces 106 is the formation of an inductive winding that may conduct an electrical current through the substrate conductive traces 106 and the flex circuit conductive traces 108. The current in the assembled winding depicted in this figure may for example proceed from the contact pad 118 through the contact opening 114, up through a first flex circuit conductive trace 108, right across the ferromagnetic core 120 and down to a first printed circuit board conductive trace 106 and left through printed circuit board conductive trace 106, etc., until reaching printed circuit board contact pad 116. The current may thus encircle the ferromagnetic core 120, for approximately 5.75 full turns for example, to induce a magnetic flux. The flex circuit 110 may be mechanically attached to the ferromagnetic core 120 as well, using glue for example, to help prevent flexure or vibration from damaging bonded or soldered connections.

While FIG. 1 shows a transformer 100 with two windings, the principles of the present invention permit the techniques described to be applied to an inductor with a single winding by wrapping a single flex circuit 110 around one leg or angular sector of the ferromagnetic core 120. Alternatively, an inductor may have multiple windings that are electrically connected to each other to form a larger inductor element. Additional windings may be formed around an opposite side of the ferromagnetic core 120, as shown in the cross-sectional view, though the inventive embodiments are not limited to such an arrangement. One or more windings may be formed around one or more adjacent sides of the ferromagnetic core 120 as well. Indeed, multiple windings may generally be formed around any particular side or sides of the ferromagnetic core 120. Further, while FIG. 1 shows a transformer 100 with two windings, each on a separate flex circuit 110, embodiments with multiple windings all on a single flex circuit 110 are also within the scope of the present invention.

Figure 6:
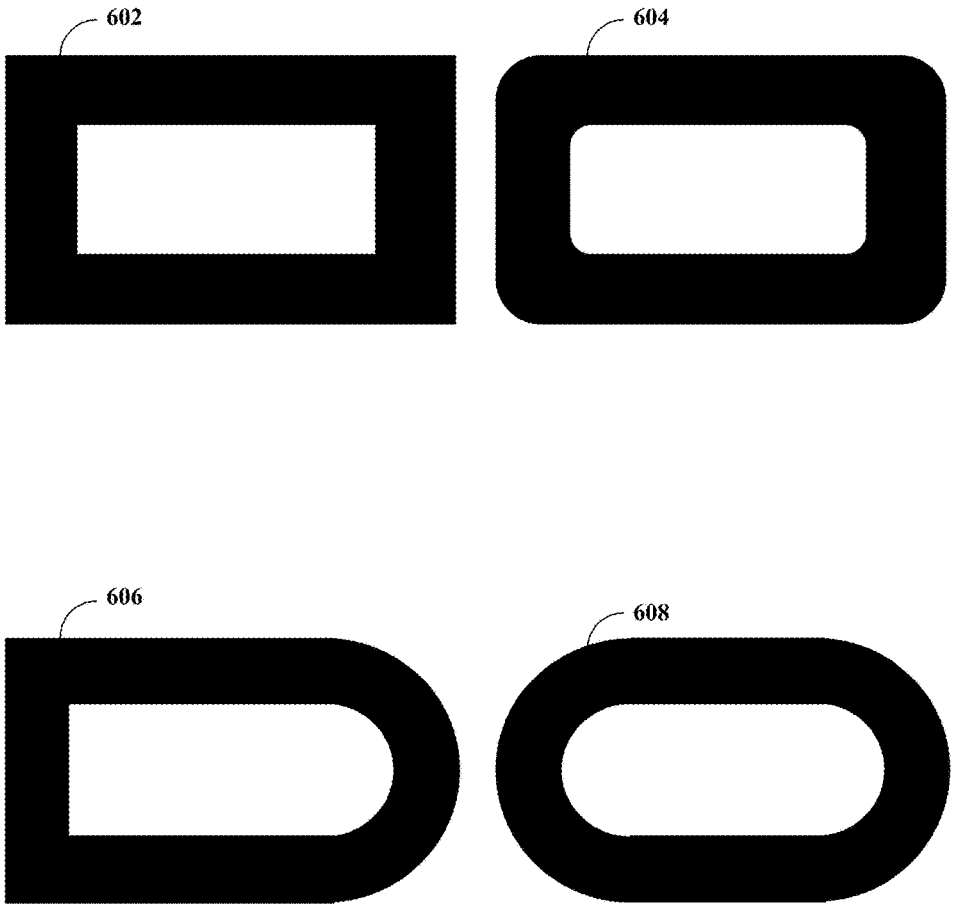
FIG. 6 is a diagram depicting exemplary toroidal ferromagnetic cores of different cross-section according to one aspect of the present invention.

Ferromagnetic cores 120 having a straight wall may enable tighter wrapping of each flex circuit 110 than would be feasible with a ferromagnetic core of circular cross-section. This straight wall feature may enable more individual flex circuits 110 to be tightly wrapped around a given side of the ferromagnetic core 120. Such ferromagnetic cores are shown in FIG. 6 and described below.

Figure 2:
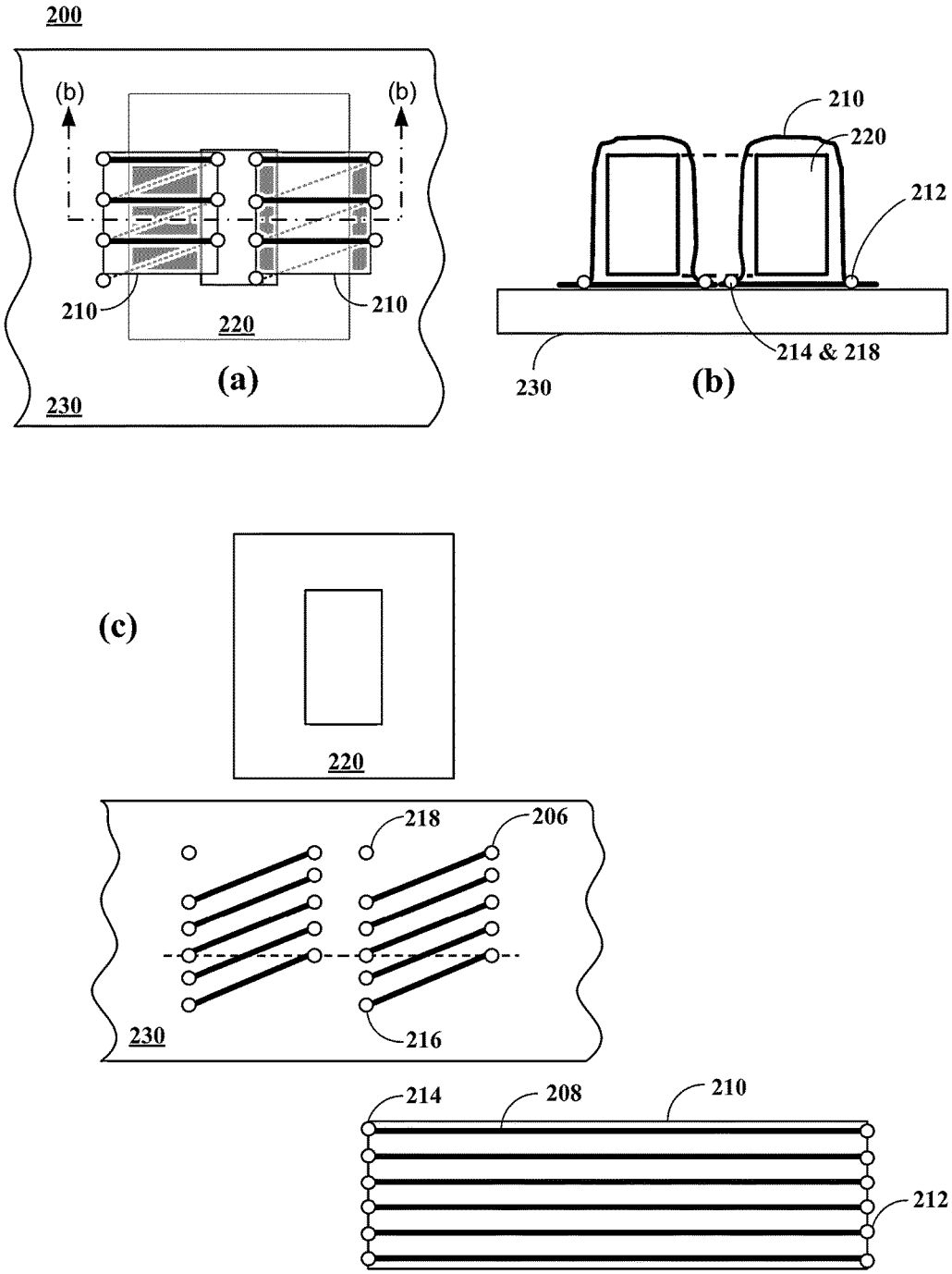
FIG. 2 is a diagram depicting a second exemplary transformer according to an embodiment of the present invention.

FIG. 2 illustrates a second transformer 200 according to another embodiment of the present invention. In this embodiment, the transformer 200 may include a pair of flex circuits 210, a ferromagnetic core 220, and a substrate 230. The ferromagnetic core 220 may be mounted on the substrate 230. Each flex circuit 210 may wrap around a portion of the ferromagnetic core 220. The flex circuits 210 and the substrate 230 may have conductive traces formed therein that may be electrically connected to each other to form a pair of windings about the ferromagnetic core 220, which complete the transformer circuit.

This embodiment may differ from that of FIG. 1 in that the substrate conductive traces 206 may be angled so that every other substrate conductive trace 206 may be aligned, as shown. Other angles or substrate conductive trace shapes may be chosen so that every $n^{th}$ conductive trace may be aligned, in general. In this embodiment, a portion of the traces 208 of the two flex circuits 210 interface with corresponding traces 206 in the substrate 230 to form a first winding. A remaining portion of the traces of the two flex circuits 210 may interface with corresponding traces in the substrate 230 to form a second winding as previously described, or may remain unused as shown.

The variation in conductive trace 206 angle may enable the formation of baluns or transmission line transformers. In this example, the windings formed may each comprise three full turns, because not all the flex circuit conductive traces 208 or the substrate conductive traces 206 are used to carry current. Note again that it is possible to use some of the flex circuit conductive traces 208 of a flex circuit 210 for a first winding, and other flex circuit conductive traces 208 of the same flex circuit 210 for a second winding, so that a single assembled flex circuit 210 alone may form a transformer 200.

Figure 3:
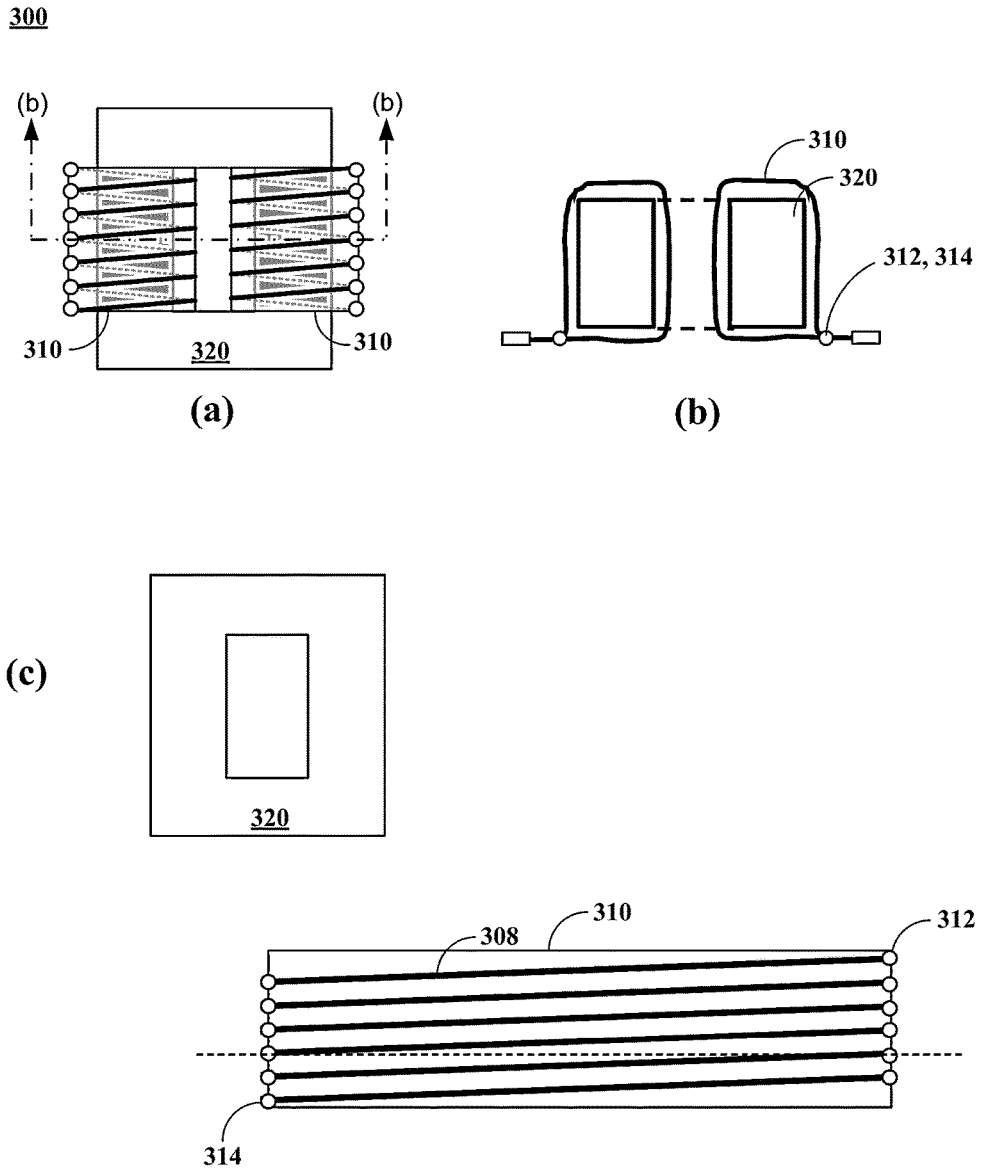
FIG. 3 is a diagram depicting a third exemplary transformer according to an embodiment of the present invention.

FIG. 3 illustrates a third transformer 300 according to another embodiment of the present invention. This transformer embodiment may comprise a flex circuit 310 wrapped substantially completely around one side of the ferromagnetic core 320 to produce an inductive winding. A second winding, shown here as a non-limiting second flex circuit 310, may complete the transformer 300. No substrate conductive traces are required to serve as part of a winding turn, as was shown with previously described embodiments.

Full flex circuit loop transformers like 300 may be assembled from the ferromagnetic core 320 and a number of flex circuits 310, and stored for later attachment to a substrate, such as a printed circuit board or another flex circuit. This distinction may enable circuit assembly operations to be parallelized and/or distributed geographically to some extent, which may be of particular utility. Alternatively, assembly of full flex circuit loop transformers may involve substantially contemporaneous component attachment to a printed circuit board or another flex circuit serving as a substrate. While this latter approach is subsequently described in more detail, the inventive embodiments are not so limited.

The flex circuit 310 may differ from the flex circuits of the partial loop transformer embodiments previously described in that its flex circuit conductive traces 308 are not necessarily aligned longitudinally with the flex circuit 310 edges. Instead, the flex circuit conductive traces 308 may be angled such that the beginning end of a given trace 308 is aligned with the opposite end of another trace 308. In this embodiment, the beginning end of a given trace 308 may be aligned with the opposite end of an immediately neighboring trace 308. The result is that a spiral winding may be formed when the flex circuit 310 is wrapped around a side of the ferromagnetic core 320. In the example shown, the resulting winding comprises six full turns, as each of the six flex circuit conductive traces 308 carries the same electrical current around the ferromagnetic core 320.

Contact pads 312 and 314 on flex circuit 310 are again shown oversized for clarity, and may be used for connecting the flex circuit 310 not only to itself but also to specific contacts on a printed circuit board or other substrate (not shown). As with previous embodiments, patterned contact openings in the flex circuit 310 may enable external electrical connections between the various flex circuit conductive traces 308 as desired. Similarly, bonding, flow soldering, or other known manufacturing methods may form permanent electrical and mechanical connections between the ends of each flex circuit 310 and/or to a printed circuit board or other substrate.

In one embodiment, particular ends of the flex circuits 310 may be secured into position on a substrate, then opposite ends of the flex circuits 310 may be fed through the ferromagnetic core 320 substantially longitudinally and wrapped around the ferromagnetic core 320 to form full loops. The order of operations may also be reversed during manufacture, so that one end of each of the flex circuits 310 may be fed through the ferromagnetic core 320 first, prior to the wrapping. Each flex circuit 310 may be secured to the ferromagnetic core 320, using glue or other known means, to prevent disconnection due to flexure or vibration prior to bonding or soldering.

Figure 4:
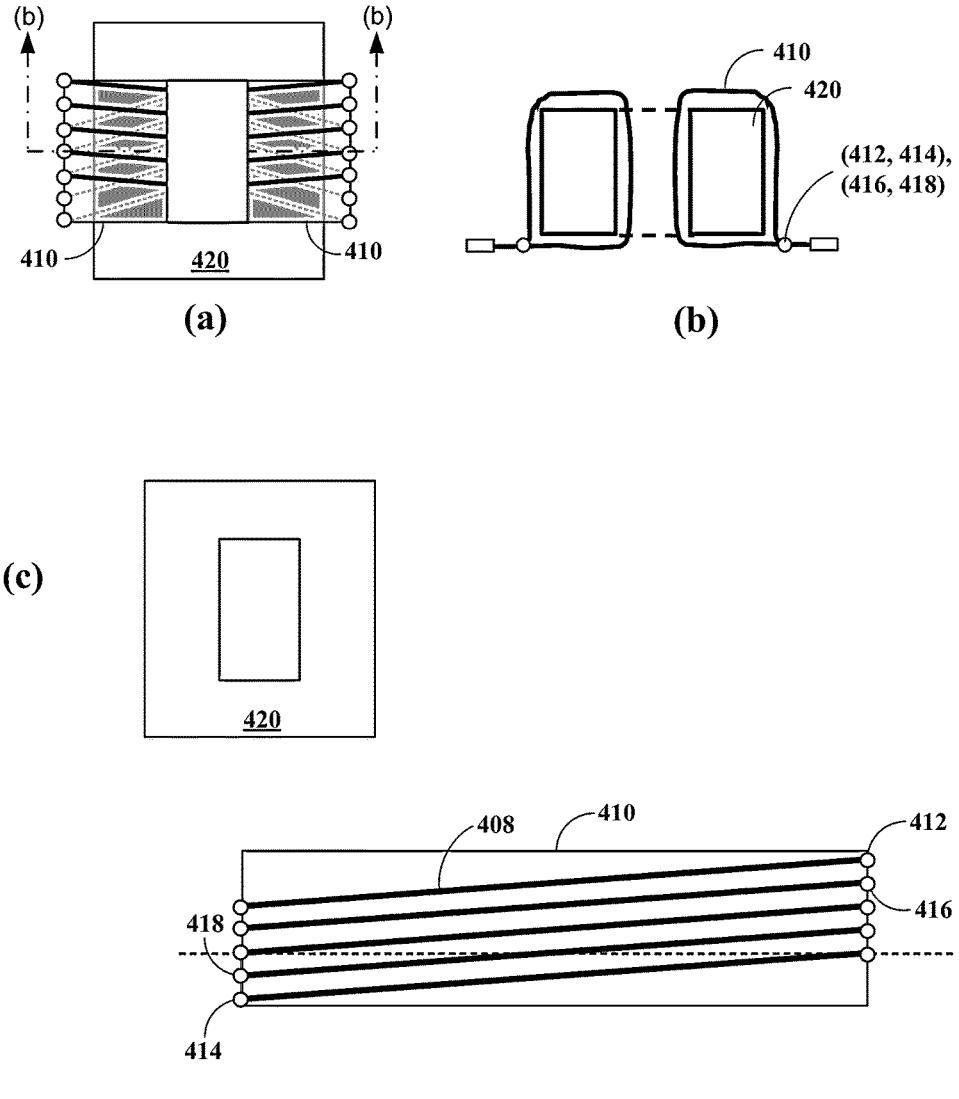
FIG. 4 is a diagram depicting a fourth exemplary transformer according to an embodiment of the present invention.

FIG. 4 shows a fourth exemplary transformer 400 according to an embodiment of the present invention. In this embodiment, the transformer 400 may include a pair of flex circuits 410 and a ferromagnetic core 420. This transformer embodiment may comprise a flex circuit 410 wrapped substantially completely around one side of the ferromagnetic core 420 to produce an inductive winding. A second winding, shown here as a non-limiting second flex circuit 410, may complete the transformer 400. No substrate conductive traces are required to serve as part of a winding turn.

This embodiment may differ from that of FIG. 3 in that the flex circuit conductive traces 408 may be angled so that every other flex circuit conductive trace 408 is aligned. Other angles may be chosen so that every $n^{th}$ flex circuit conductive trace 408 may be aligned, in general. The variation in the flex circuit conductive trace 408 angle may enable the formation of baluns or transmission line transformers. In this example, the outermost winding formed may comprise three full turns, because only the two outermost and center flex circuit conductive traces 408 are used to conduct its electrical current. A second winding formed by the same flex circuit 410 as shown comprises only two full turns, because only the second and fourth flex circuit conductive traces 408 shown are used to conduct its electrical current. Any number of flex circuit conductive traces may be placed on any flex circuit of any embodiment, as long as sufficient space exists in the central cavity of the ferromagnetic core.

Figure 5:
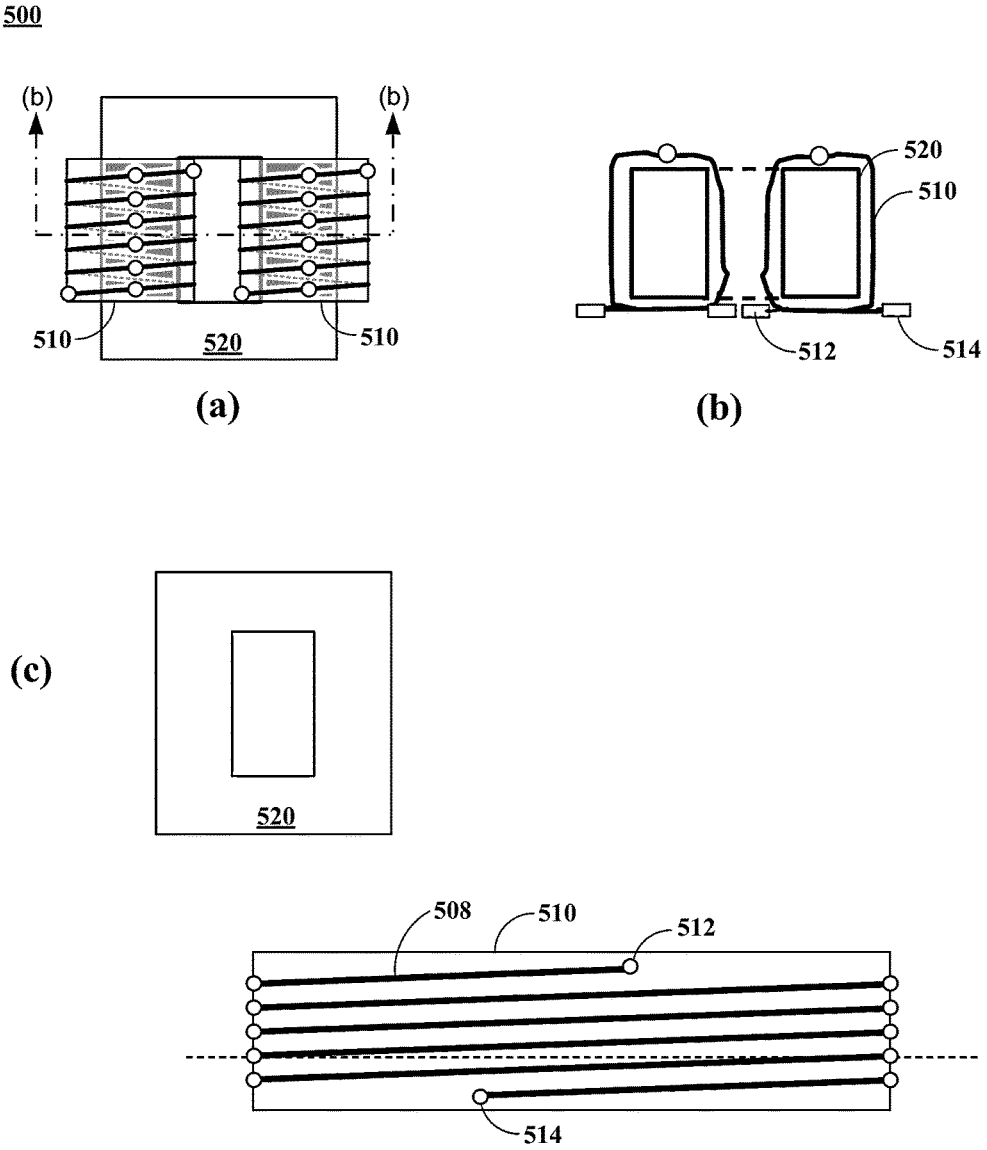
FIG. 5 is a diagram depicting a fifth exemplary transformer according to an embodiment of the present invention.

FIG. 5 shows a fifth exemplary transformer 500 according to an embodiment of the present invention. In this embodiment, the transformer 500 may include a pair of flex circuits 510 and a ferromagnetic core 520. This transformer embodiment may comprise a flex circuit 510 wrapped substantially completely around one side of the ferromagnetic core 520 to produce an inductive winding. A second winding, shown here as a non-limiting second flex circuit 510, may complete the transformer 500. No substrate conductive traces are required to serve as part of a winding turn.

This embodiment may differ from that of FIG. 3 in that flex circuit conductive traces 508 may have pads 512 and 514 (again shown oversized for clarity) spaced laterally around the center of flex circuit 510. Each separate end of the flex circuit 510 may be wrapped "upward" around the ferromagnetic core 520 for connection on the opposite side (or "top") of the ferromagnetic core 520. Thus, the placement of the flex circuit conductive trace 508 contact points on the flex circuit 510 may generally be varied to best locate connections for most easily managing manufacturing operations and reducing costs.

FIG. 6 shows exemplary toroidal ferromagnetic cores 602-608 of different cross-sectional plan views, according to an embodiment of the present invention. In this figure, the cross-sections are taken through each ferromagnetic core along a plane that is perpendicular to the axis of the central cavity; that is, with the ferromagnetic core cavity facing upward, the cross-section is taken through a horizontal plane. The toroidal ferromagnetic cores described herein are not necessarily circular, but rather may be more square or rectangular in shape. For example, while toroid 602 features entirely rectangular corners, toroid 604 has both rounded inner corners and rounded outer corners. Toroid 606 is rectangular except for one end, which is rounded on both inside and outside corners. Toroid 608 is oval in shape, but has two straight sides. The toroids may comprise ferrite polymer or similar known ferromagnetic materials, and may be mechanically rigid.

In this description each of these exemplary and non-limiting ferromagnetic cores is referred to merely as a "toroid", and may be used for construction of any of the embodiments described. These ferromagnetic cores may have at least one side that has a straighter shape than would be the case with a circular cross-sectioned ferromagnetic core. The straight-edge ferromagnetic core feature may be particularly advantageous, and thus of particular utility, for manufacture of transformers using flex circuits as described. Nonetheless, ferromagnetic cores of circular horizontal cross-section are also within the scope of the inventive embodiments. The dimensions of the typical toroid may be less than one centimeter along the outer edge, and may be as small as approximately one millimeter along an inside edge, although larger toroids are also within the scope of the inventive embodiments.

Figure 7:
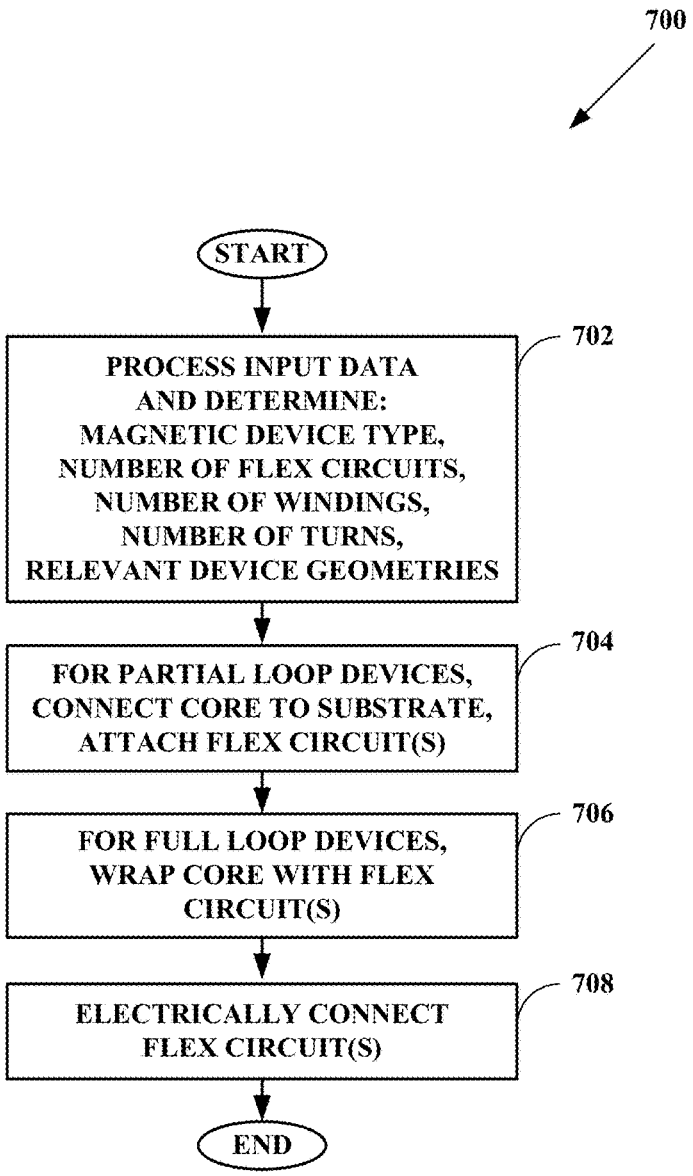
FIG. 7 is a flowchart describing flex circuit magnetic device manufacturing methods according to one aspect of the present invention.

Referring now to FIG. 7, a flowchart describing manufacturing methods for the devices previously described is shown according to one aspect of the present invention. The flowchart may describe operations carried out by a processor by following executable instructions stored in a non-transitory computer program product, for example. The instructions may control the manufacture of the magnetic devices of various exemplary embodiments described above.

At 702, the method may determine from input data whether a partial loop magnetic device or a full loop magnetic device is to be assembled, the number of flex circuits, the number of windings, and the number of turns for each winding. Relevant geometries for the flex circuit(s) and ferromagnetic core selected may also be discerned. At 704, the method may selectively attach a ferromagnetic core to a printed circuit board or other substrate and attach a certain number of flex circuits to form partial loop flex circuit magnetic devices. At 706, the method may selectively wrap a certain number of flex circuits around a ferromagnetic core to form full loop flex circuit magnetic devices. At 708, the method may perform bonding or flow soldering or other manufacturing operations to electrically connect flex circuits according to input design data.

While particular embodiments of the present invention have been described, it is to be understood that various different modifications within the scope and spirit of the invention are possible. The invention is limited only by the scope of the appended claims.

As described above, one aspect of the present invention relates to magnetic devices and their methods of manufacture. The provided description is presented to enable any person skilled in the art to make and use the invention. For purposes of explanation, specific nomenclature is set forth to provide a thorough understanding of the present invention. Description of specific applications and methods are provided only as examples. Various modifications to the preferred embodiments will be readily apparent to those skilled in the art and the general principles defined herein may be applied to other embodiments and applications without departing from the spirit and scope of the invention. Thus the present invention is not intended to be limited to the embodiments shown, but is to be accorded the widest scope consistent with the principles and steps disclosed herein.

As used herein, the terms "a" or "an" mean one or more than one. The term "plurality" means two or more than two. The term "another" is defined as a second or more. The terms "including" and/or "having" are open ended (e.g., comprising). Reference throughout this document to "one embodiment", "certain embodiments", "an embodiment" or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation. The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

In accordance with the practices of persons skilled in the art of computer programming, embodiments are described with reference to operations that may be performed by a computer system or a like electronic system. Such operations are sometimes referred to as being computer-executed. It will be appreciated that operations that are symbolically represented include the manipulation by a processor, such as a central processing unit, of electrical signals representing data bits and the maintenance of data bits at memory locations, such as in system memory, as well as other processing of signals. The memory locations where data bits are maintained are physical locations that have particular electrical, magnetic, optical, or organic properties corresponding to the data bits.

When implemented in software, the elements of the embodiments are basically the code segments to perform the particular tasks. The non-transitory code segments may be stored in a processor readable medium or computer readable medium, which may include any medium that may store or transfer information. Examples of such media include an electronic circuit, a semiconductor memory device, a read-only memory (ROM), a flash memory or other non-volatile memory, a floppy diskette, a CD-ROM, an optical disk, a hard disk, a fiber optic medium, etc. User input may include any combination of a keyboard, mouse, touch screen, voice command input, etc. User input may similarly be used to direct a browser application executing on a user's computing device to one or more network resources, such as web pages, from which computing resources may be accessed.

What is claimed is:

1. A magnetic device, comprising:

a single-piece toroid; and at least one flex circuit comprising a first conductive trace, a second conductive trace, and a third conductive trace, the second conductive trace being between the first and third conductive traces, wherein an end of the first conductive trace aligns with an opposite end of the third conductive trace along a first direction and wherein the first, second, and third conductive traces have respective ends aligning with each other along a second direction substantially perpendicular to the first direction, wherein the first, second, and third conductive traces form at least part of at least two distinct spiral windings around the toroid to inductively couple magnetic flux from at least one electrical current to the toroid.

2. The device of claim 1, wherein the device is configured as an inductor or a transformer.

3. The device of claim 1, wherein the toroid comprises ferrite.

4. The device of claim 1, wherein the at least one flex circuit includes multiple flex circuits, each flex circuit forming at least one winding around the toroid.

5. The device of claim 1, wherein the toroid is attached to a printed circuit board only by the flex circuit.

6. The device of claim 1, wherein the toroid is rigid.

7. The device of claim 1, wherein an angular orientation of the first, second, and third conductive traces determines a number of the at least two distinct spiral windings.

8. The device of claim 1, wherein the single-piece toroid comprises a straight wall.

9. A method of manufacturing a magnetic device, comprising:

forming at least part of at least two distinct spiral windings around a single-piece toroid by wrapping a flex circuit around the single-piece toroid, the flex circuit comprising first, second, and third conductive traces, wherein the second conductive trace is disposed between the first and third conductive traces, wherein an end of the first conductive trace aligns with an opposite end of the third conductive trace along a first direction, and wherein the first, second, and third conductive traces have respective ends aligning with each other along a second direction substantially perpendicular to the first direction.

10. The method of claim 9, further comprising configuring the device as an inductor or a transformer.

11. The method of claim 9, further comprising wrapping additional flex circuits around the toroid, wherein each flex circuit forms at least one winding around the toroid.

12. The method of claim 9, further comprising attaching the assembly to a printed circuit board.

13. The method of claim 12, wherein the assembly is attached to the printed circuit board only by the flex circuit.

14. The method of claim 9, wherein an angular orientation of the first, second, and third conductive traces determines a number of winding turns.

15. The method of claim 11, further comprising electrically connecting windings of two flex circuits wrapped around the toroid.

16. A transformer, comprising:

a substrate having first, second, and third trace segments formed thereon, wherein the second trace segment is disposed between the first and third trace segments, an end of the first trace segment aligns with an opposite end of the third trace segment along a first direction, and wherein the first, second, and third trace segments of the substrate have respective ends aligned with each other along a second direction substantially perpendicular to the first direction;

a toroidal magnetic core; and a flex circuit wrapping around the core, and having a plurality of trace segments formed therein, wherein at least one trace segment of the plurality of trace segments of the flex circuit is electrically coupled to the first and third trace segments of the substrate to form a first winding of the transformer and wherein a second trace segment of the plurality of trace segments of the flex circuit is electrically coupled to the second trace segment of the substrate to form a second winding of the transformer.

17. The transformer of claim 16, wherein the flex circuit is a first flex circuit, and the transformer further comprises a second flex circuit having a plurality of trace segments formed therein, the first and second flex circuits wrapping around respective portions of the core; a first subset of trace segments of the first flex circuit, a first subset of trace segments of the second flex circuit, and a first subset of trace segments of the substrate are electrically interconnected to each other to form the first winding of the transformer; and a second subset of trace segments of the first flex circuit, a second subset of trace segments of the second flex circuit, and a second subset of trace segments of the substrate are electrically interconnected to each other to form the second winding of the transformer.

18. The transformer of claim 16, wherein the substrate is a printed circuit board, and the core is attached to the printed circuit board.

19. The transformer of claim 16, wherein the toroidal magnetic core comprises a straight wall.

20. The transformer of claim 16, wherein the toroidal magnetic core is a single-piece toroid.

* * * * *